US005584227A

United States Patent [19]

Chung

[11] Patent Number: 5,584,227

[45] Date of Patent: Dec. 17, 1996

[54] VARIABLE PRIORITY DEVICE

[75] Inventor: Dae S. Chung, Pusan, Rep. of Korea

[73] Assignee: Samsung Heavy Industries Co., Ltd., Seoul, Rep. of Korea

[21] Appl. No.: 497,574

[22] Filed: Jun. 30, 1995

[30] Foreign Application Priority Data

Sep. 30, 1994 [KR] Rep. of Korea ..... 94-25347

[51] Int. Cl.[6] ..... F15B 11/00

[52] U.S. Cl. ..... 91/532; 91/446

[58] Field of Search ..... 91/532, 511, 512, 91/518, 446

[56] References Cited

U.S. PATENT DOCUMENTS

| | | | |
|---|---|---|---|
| 4,020,867 | 5/1977 | Sumiyoshi | 91/532 X |
| 4,508,013 | 4/1985 | Barbagli | 91/518 X |
| 4,850,191 | 7/1989 | Kreth et al. | 91/532 X |
| 4,856,278 | 8/1989 | Widmann et al. | 91/446 X |
| 4,953,447 | 9/1990 | Bender | 91/532 X |
| 5,315,826 | 5/1994 | Hirata et al. | 91/532 X |
| 5,386,697 | 2/1995 | Claudinon et al. | 91/446 X |
| 5,409,038 | 4/1995 | Yoshida et al. | 91/446 X |
| 5,447,093 | 9/1995 | Budzich | 91/446 |

FOREIGN PATENT DOCUMENTS

| | | | |
|---|---|---|---|
| 1-266301A | 10/1989 | Japan | 91/532 |

*Primary Examiner*—John E. Ryznic
*Attorney, Agent, or Firm*—Kenyon & Kenyon

[57] ABSTRACT

A priority control valve used in a hydraulic apparatus for supplying fluid delivered from a single pump to at least two actuators respectively via parallel fluid lines, the actuators operating independently or in combination with each other. The variable priority device includes a priority control valve installed in the parallel fluid line associated with one of the actuators and adapted to be switched between an orifice state and an orifice release state, the priority control valve being initially maintained at the orifice release state by resilience means while being switched from the orifice release state to the orifice state against a resilience of the resilience means in response to a pilot pressure for moving the spool of a control valve for the other actuator. A feedback fluid line is connected between the parallel fluid line associated with the one actuator and the priority control valve to apply a fluid pressure exerted therein to the priority control valve against the pilot pressure so that the priority control valve can be switched from the orifice state to the orifice release state in response to an increase in fluid pressure in the associated parallel fluid line.

2 Claims, 2 Drawing Sheets

VARIABLE PRIORITY DEVICE

BACKGROUND OF THE INVENTION

1. Field of the Invention

The present invention relates to variable priority devices, and more particularly to a variable priority device employed in a variety of construction machines such as excavators.

2. Description of the Prior Art

Where at least two actuators are operated in a combined manner by oil delivered from a single pump, a "priority" is established to control the actuators such that one of the actuators is supplied with a larger amount of oil than the other actuator. For example, excavators have a priority of the swing actuator over the arm actuator and a priority of the boom over the bucket. The reason why such priorities are given is because in most cases, the amount of oil required for a swing operation is larger than the amount of oil required for an arm operation, and the amount of oil required for a boom operation is larger than the amount of oil required for a bucket operation. As oil is supplied in different amounts depending on the kind of operation in accordance with the priorities, it is possible to prevent an unnecessary loss of pressure and achieve a smooth operation.

In order to provide such a priority function, there have been used stroke limiters, fixed orifices and variable orifices.

Referring to FIG. 1, there is shown a conventional stroke limiter. The stroke limiter, which is denoted by the reference numeral 101, is installed in a control valve A equipped in an actuator which is associated with the stroke limiter. The stroke limiter 101 serves to limit the stroke of the spool of control valve A within a desired range, thereby preventing the fluid supply passage 105.

A conventional fixed orifice is illustrated in FIG. 2. As shown in FIG. 2, the fixed orifice denoted by the reference numeral 201 is disposed in a parallel oil passage 203 to always limit the amount of oil supplied to a control valve A of the actuator associated therewith.

However, the above-mentioned conventional devices have a problem that the oil passage or line is always limited on the oil amount passing therethrough, irrespective of whether the actuator associated operates alone or in combination with the other actuator. Where the associated actuator operates alone, the limitation on the oil amount results in various problems such as an unnecessary loss of pressure and a decrease in the operating speed of the actuator.

Referring to FIG. 3, there is illustrated a variable orifice. As shown in FIG. 3, the variable orifice denoted by the reference numeral 301 is installed in a parallel fluid line 303. The variable orifice 301 is switched between its orifice state and its orifice release state in response to a pilot pressure Pi for moving the spool of a control valve 302. The variable orifice 301 is initially set to be at the orifice release state by a spring 305 when no pilot pressure is exerted. When the control valve 304 operates alone, the variable orifice 301 is maintained at its orifice release state because no pilot pressure is exerted thereon. At this state, a sufficient amount of fluid is normally supplied to the control valve 304. Only when the control valve 302 operates, the variable orifice 301 is switched to its orifice state by the pilot pressure Pi exerted thereon against the resilience of the spring 305, thereby performing its priority function. That is, the variable orifice 301 decreases the amount of fluid supplied to the control valve 304 and correspondingly increases the control valve 302 by the decreased fluid amount.

However, such a variable orifice involves a problem that an unnecessary loss of pressure occurs at the fluid line associated with the control valve 304 due to the orifice function when the load of the actuator associated with the control valve 304 is rather larger than that of the actuator associated with the control valve 302, nevertheless it is unnecessary in this case to provide the orifice function for establishing a desired priority. Where the actuator associated with the control valve 304 and the actuator associated with the control valve 302 are an arm cylinder and a swing motor, respectively, the load applied to the arm cylinder may be larger than that applied to the swing motor. Even in this case, the conventional variable orifice limits the amount of fluid supplied to the arm cylinder because it is constructed to always limit the amount of fluid supplied to the arm cylinder during an operation of the swing motor. As a result, a relatively larger amount of fluid is undesirably supplied to the swing motor. In other words, the conventional variable orifice is impossible to optimally cope with a variation in load occurring at the side of the arm cylinder. Consequently, this variable orifice involves various problems such as a decrease in the operating speed of the arm cylinder, a loss of pressure and an inefficient fluid distribution.

SUMMARY OF THE INVENTION

Therefore, an object of the invention is to provide a variable priority device for establishing a priority among various actuators of heavy construction equipment such as the priority of the swing actuator over the arm actuator or the priority of the boom over the bucket, capable of optimally coping with a variation in load occurring at each actuator, thereby avoiding a loss of pressure, ensuring an increased operating speed of each actuator and achieving an efficient fluid distribution.

In accordance with the present invention, this object can be accomplished by providing in a hydraulic apparatus for supplying fluid delivered from a single pump to at least two actuators respectively via parallel fluid lines, the actuators operating independently or in combination with each other, a variable priority device comprising: a priority control valve installed in the parallel fluid line associated with one of the actuators and adapted to be switched between an orifice state and an orifice release state, the priority control valve being initially maintained at the orifice release state by resilience means while being switched from the orifice release state to the orifice state against a resilience of the resilience means in response to a pilot pressure for moving the spool of a control valve for the other actuator; and means for switching the priority control valve from the orifice state to the orifice release state in response to an increase in fluid pressure in the parallel fluid line associated with the one actuator.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
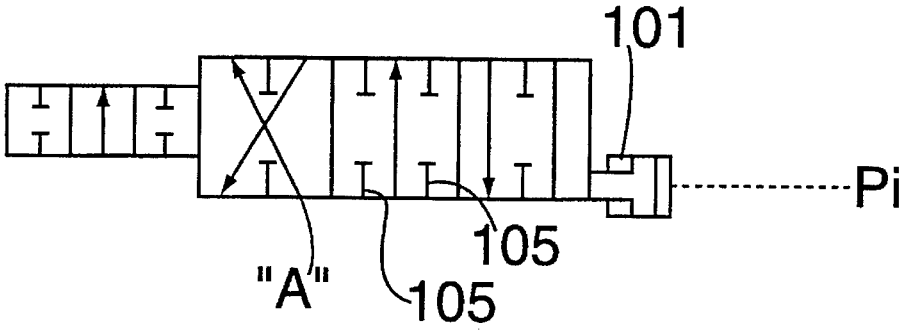
FIG. 1 PRIOR ART
FIG. 1 is a circuit diagram illustrating a hydraulic circuit to which a conventional stroke limiter is applied.
Figure 2:
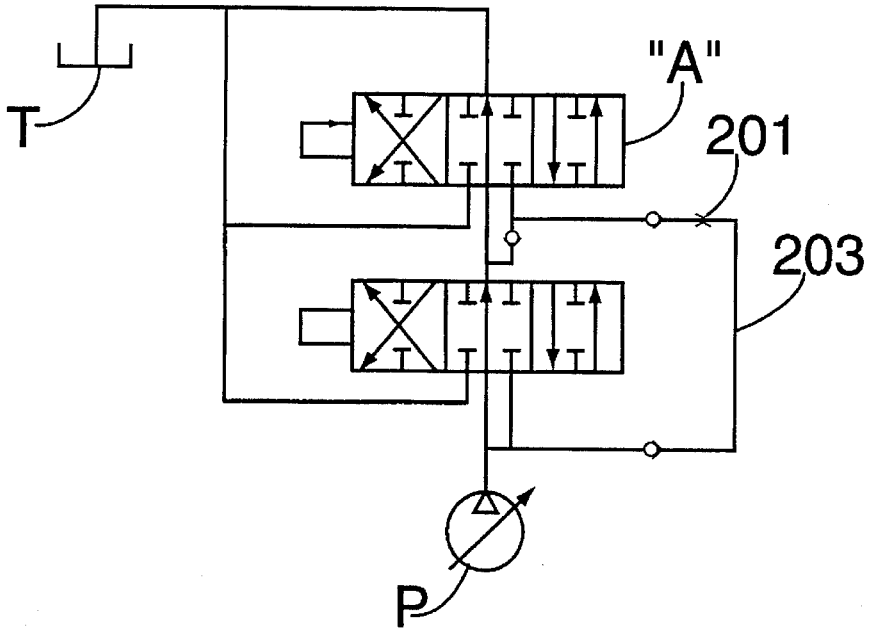
FIG. 2 PRIOR ART
FIG. 2 is a circuit diagram illustrating a hydraulic circuit to which a conventional fixed orifice is applied.
Figure 3:
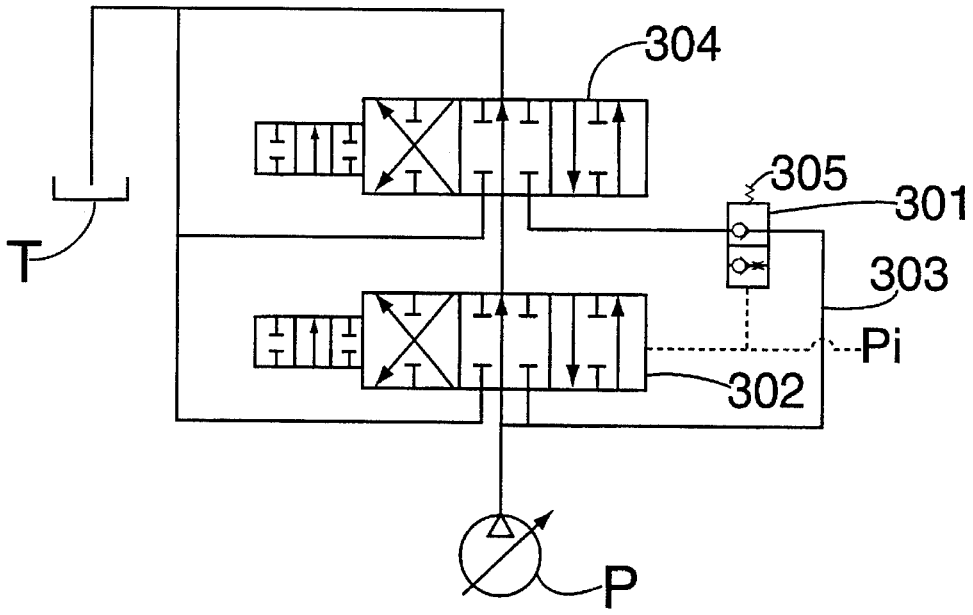
FIG. 3 PRIOR ART
FIG. 3 is a circuit diagram illustrating a hydraulic circuit to which a conventional variable orifice is applied.
Figure 4:
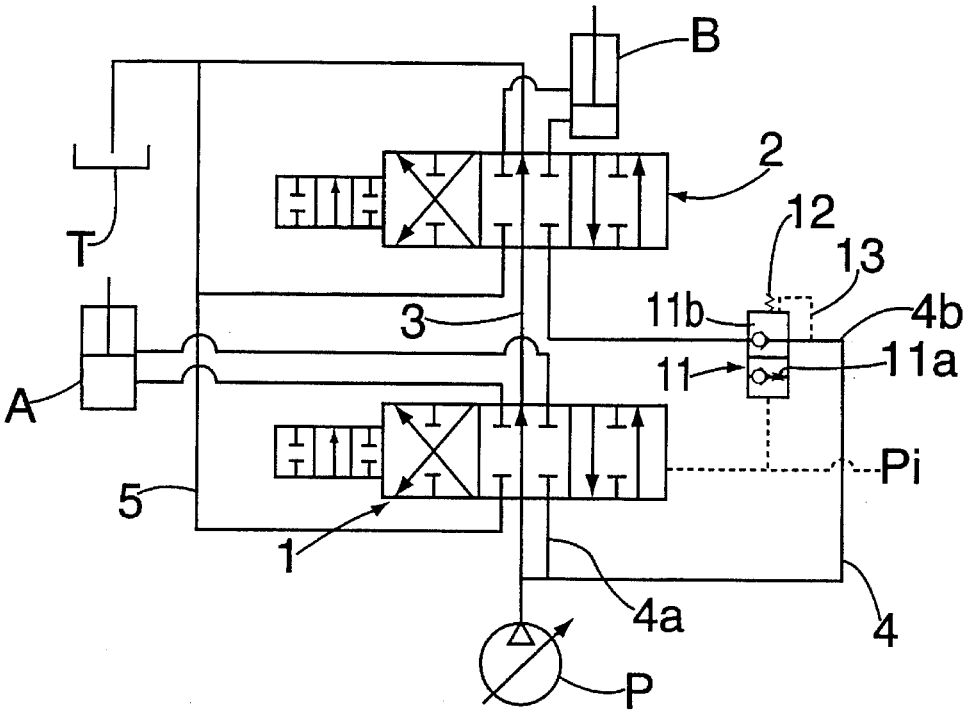
FIG. 4 is a circuit diagram illustrating a hydraulic circuit to which a variable priority device in accordance with the present invention is applied.

FIG. 4 illustrates the hydraulic circuit of a heavy construction equipment to which a variable priority device in accordance with an embodiment of the present invention is applied.

Referring to FIG. 4, a pair of actuators A and B are shown which operate by a flow of fluid delivered from a single hydraulic pump P independently or in combination-with each other. In FIG. 4, the reference numeral 1 denotes a control valve for switching supplying and discharging of fluid associated with the actuator A, and the reference numeral 2 denotes a control valve for switching supplying and discharging of fluid associated with the actuator B.

With respect to this embodiment of the present invention, an assumption is made that a priority of the actuator A over the actuator B should be established because the amount of fluid required for the actuator A is normally larger than that for the actuator B. For example, the actuators A and B may be a bucket cylinder and a boom cylinder, respectively. In a parallel fluid line **4*b* associated with the actuator B, a priority control valve 11 is installed, which is switched between an orifice state 11*a* and an orifice release state 11*b* in response to a predetermined pilot pressure. The priority control valve 11 is initially set to be maintained at the orifice release state 11*b* by a pressure setting spring 12 exerting a resilience thereon. As the pilot pressure for switching the priority control valve 11, a pilot pressure Pi adapted to move the spool of the control valve 1 is used as it is. When the pilot pressure Pi is exerted on the priority control valve 11, it forces the priority control valve 11 to be switched to the orifice state 11*a* against the resilience of pressure setting spring 12. In other words, when the spool of control valve 1 moves, that is, when the actuator A operates, a flow of fluid supplied from the parallel fluid line 4 to the control valve 2 is always limited because the priority control valve 11 is maintained at the orifice state 11*a*. In this case, the control valve 1** is supplied with an additional fluid amount corresponding to the limited fluid amount. Thus, a priority of the actuator A over the actuator B is established.

In accordance with the illustrated embodiment of the present invention, there is also provided a feedback fluid line 13 which serves to switch the priority control valve 11 from the orifice state **11*a* to the orifice release state 11*b* in response to an increase in fluid pressure in the parallel fluid line 4*b* associated with the control valve 2. The feedback fluid line 13 branches from the parallel fluid line 4*b* and communicates with the priority control valve 11 such that it applies its fluid pressure to the priority control valve 11** against the pilot pressure Pi.

In FIG. 4, the reference numeral 3 denotes a center bypass fluid line for returning a flow of fluid delivered from the hydraulic pump P without any resistance when both the control valves 1 and 2 are at a neutral state. The reference numerals **4*a* denotes a parallel fluid line associated with the control valve 1 whereas the reference numeral 5** denotes a return fluid line.

When the actuators A and B operate simultaneously, the priority control valve 11 is switched to the orifice state 11 by the pilot pressure Pi. At the orifice state 11, the priority control valve 11 limits the amount of fluid supplied to the actuator B so that the actuator A is additionally supplied with an amount of fluid corresponding to the limited fluid amount. Thus, the actuator A has a priority over the actuator B. When the load applied to the actuator B increases under the above condition, the fluid pressure in the parallel fluid line **4*b* is increased. The increased fluid pressure is applied to the priority control valve 11 via the feedback fluid line 13, thereby moving the spool of priority control valve 11 in a downward direction, when viewed in FIG. 4, against the pilot pressure Pi. As a result, the priority control valve 11 is switched to the orifice release state 11*b*, thereby increasing the fluid amount supplied to the actuator B to at least a level approximate to the fluid amount supplied to the actuator A. In other words, the switching of priority control valve 11 between the orifice state 11*a* and the orifice release state 11*b*** is optimally carried out to cope with the variation in load occurring at the side of the actuator A. Accordingly, it is possible to ensure an increased operating speed of the actuator B and achieve an efficient fluid distribution.

As apparent from the above description, the present invention provides a variable priority device for establishing a priority among various actuators of heavy construction equipment such as the priority of the swing actuator over the arm actuator or the priority of the boom over the bucket, capable of optimally coping with a variation in load occurring at each actuator, thereby avoiding a loss of pressure, ensuring an increased operating speed of each actuator and achieving an efficient fluid distribution.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. In a hydraulic apparatus for supplying fluid delivered from a single pump to at least two actuators respectively via parallel fluid lines, the actuators operating Independently or in combination with each other, a variable priority device comprising:

a priority control valve installed in the parallel fluid line associated with one of the actuators and adapted to be switched between an orifice state and an orifice release state, the priority control valve being initially maintained at the orifice release state by resilience means while being switched from the orifice release state to the orifice state against a resilience of the resilience means in response to a pilot pressure for moving the spool of a control valve for the other actuator; and means for switching the priority control valve from the orifice state to the orifice release state in response to an increase in fluid pressure in the parallel fluid line associated with the one actuator.

2. The variable priority device in accordance with claim 1, wherein the means comprises a feedback fluid line branching at one end thereof from the parallel fluid line associated with the one actuator and communicating at the other end thereof with the priority control valve to apply a fluid pressure exerted therein to the priority control valve against the pilot pressure.

* * * * *